US005265445A

United States Patent [19]

Shytles et al.

[11] Patent Number: 5,265,445

[45] Date of Patent: Nov. 30, 1993

[54] BREATHABLE ELASTIC FABRIC AND METHOD OF MAKING SAME

[76] Inventors: Douglas M. Shytles, 141 Candlewood Dr., Kings Mountain, N.C. 28086; Bobby R. Canipe, 5709 Falston Rd., Lawndale, N.C. 28090

[21] Appl. No.: 937,048

[22] Filed: Sep. 1, 1992

[51] Int. Cl.[5] ..... D04B 23/08; D04B 23/10

[52] U.S. Cl. ..... 66/192; 66/193; 602/76

[58] Field of Search ..... 66/190, 191, 192, 193, 66/194, 195, 196; 602/44, 76, 75

[56] References Cited

U.S. PATENT DOCUMENTS

| | | | |
|---|---|---|---|
| 1,475,325 | 11/1923 | Springthorpe | 66/191 |
| 2,845,783 | 9/1958 | Underwood et al. | 66/193 |
| 2,853,806 | 9/1958 | White | 66/193 |
| 3,213,646 | 10/1965 | Van Patten | 66/191 |
| 3,999,407 | 12/1976 | Odham | 66/193 |
| 4,074,543 | 2/1978 | Schmidt | 66/193 |
| 4,818,316 | 4/1989 | Weinle et al. | 66/193 X |
| 5,125,246 | 6/1992 | Shytles | 66/191 X |

*Primary Examiner*—Clifford D. Crowder
*Assistant Examiner*—John Calvert
*Attorney, Agent, or Firm*—Mason, Fenwick & Lawrence

[57] ABSTRACT

A method of making a breathable elastic web fabric comprises the steps of forming rows of chain stitches using a set of chain threads to define a plurality of lengthwise wales and widthwise courses, moving the front and back weft threads from side to side on each course in a pre-determined pattern as each course is formed to tie the wales and chain stitches together and to provide a plurality of staggered ventilation holes, and laying-in one elastomeric thread in each of the wales. The elastomeric thread is sandwiched between the front weft threads and the back weft threads, and enclosed in the underlap of each chain stitch. Preferably, the holes are formed in sets, the holes in each set being separated by at least one locking stitch to provide widthwise stability. In a pattern repeat of twelve courses and twenty four wales, the pattern for each weft bar is 1, 9, 1, 10, 1, 9, 5, 13, 4, 13, 5, 13. The holes comprise approximately 12 to 25 per cent of the extended surface area of the fabric.

22 Claims, 2 Drawing Sheets

BREATHABLE ELASTIC FABRIC AND METHOD OF MAKING SAME

BACKGROUND OF THE INVENTION

1. Field of the Invention

The present invention relates to breathable elastic web fabric with ventilation holes and a method for making same. More specifically, the invention relates to a breathable elastic web fabric with ventilation holes suitable for use as in an orthopedic belt and lumbar support.

2. Related Art

In order to produce elastic webbing of varying widths, for example from 2 inches to 24 inches, for use as orthopedic belts and lumbar supports, it has been customary to traverse the weft threads completely across the web width, thereby giving a solid structure to the webbing and providing stability from widthwise stretch. This method produces a dense fabric which allows very little "breathing" or interchange of air through the web. The resulting fabric also inhibits moisture transport which is essential for body comfort when the belts are worn for extended periods of time. Frequently, body rash can develop from such moisture imperviousness.

In an effort to overcome these problems, various efforts were made in the prior art to design elastic webs which would have openings, meshes, or holes which would facilitate the necessary breathing and moisture transport and still maintain the strength and stability necessary to the ultimate use of the web in lumbar support belts and devices. Early efforts to create the necessary holes in general caused a deterioration of widthwise stability of the web, making it less suitable for lumbar support. When widthwise stress was applied to the fabric with holes, it was strained around the holes and did not fully recover its original configuration. It is the solution of these and other problems to which the present invention is directed.

SUMMARY OF THE INVENTION

It is therefore a primary object of the present invention to provide an elastic web fabric with a pattern of holes which are in sufficient quantity and size to allow ventilation and the escape of moisture.

It is another object of the present invention to provide an elastic web fabric which in addition to the pattern of holes, has resistance from distorting strain in a crosswise direction when stress is applied. Any small strain resulting from the stress recovers once the stress is removed.

To accomplish these and other objects, a series of weft threads is used instead of threads which traverse the entire width of the fabric. The weft threads are divided into two sets, the front weft threads and the back weft threads. The threads are spaced eight needles apart in each set. The set of threads carried by a bar is traversed back and forth across the needle bed using the same pattern sequence for each bar.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
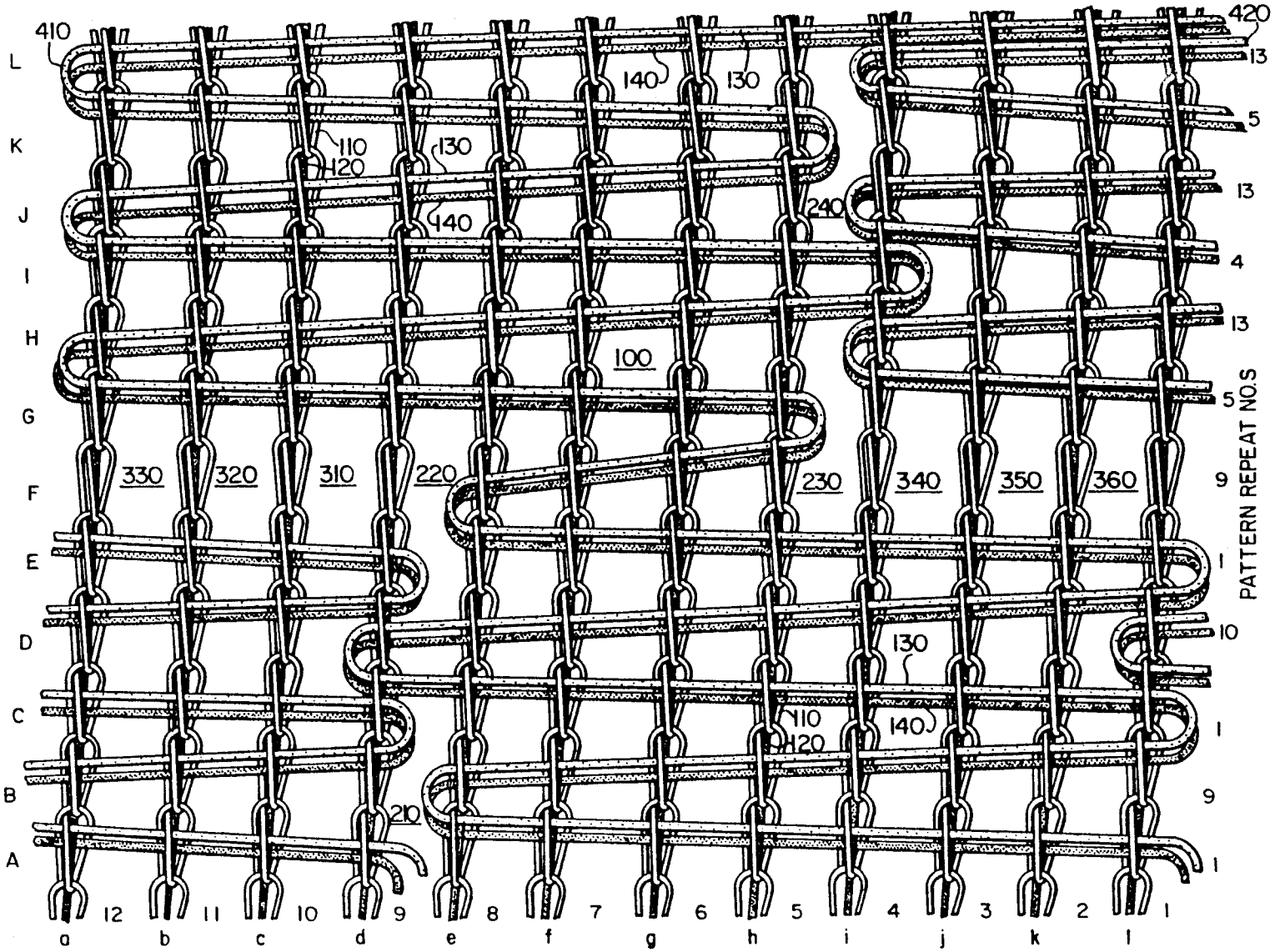
FIG. 1 is a schematic drawing of an elastic web fabric in accordance with the present invention.
Figure 2:
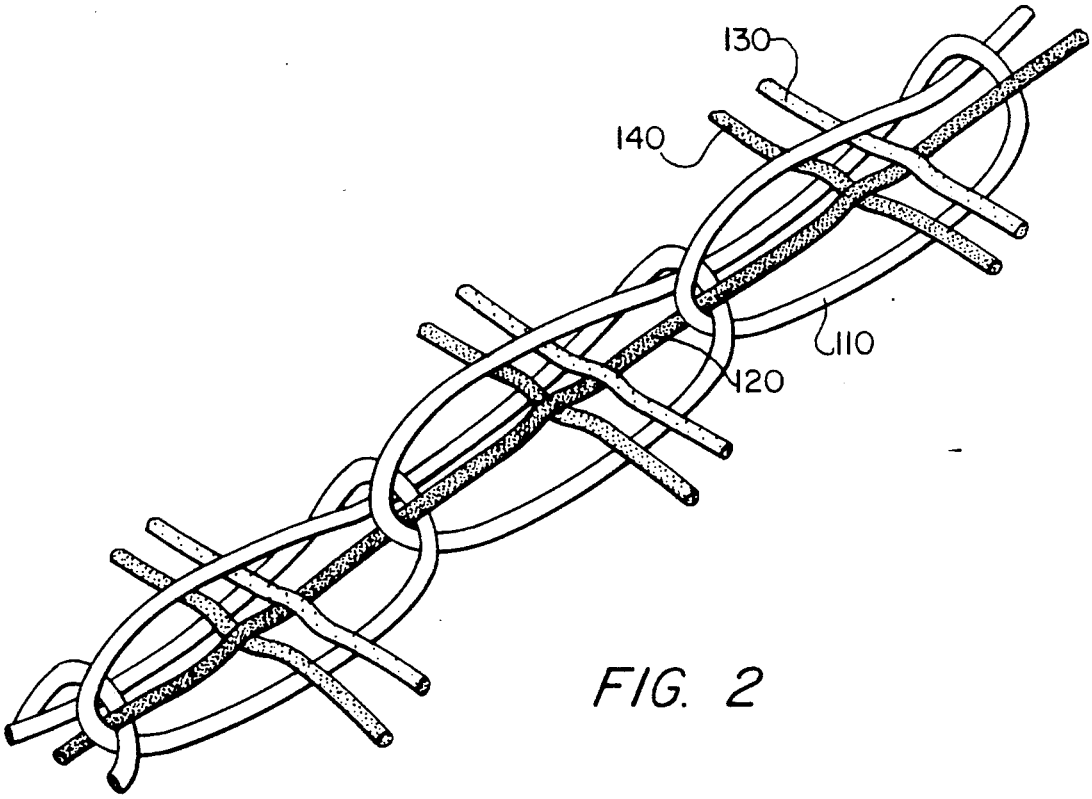
FIG. 2 is a perspective view of a portion of one wale of the elastic web fabric of FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIG. 1, there is shown a segment of the web fabric 100 in accordance with the present invention. The segment comprise twelve courses and twelve wales, designated respectively as A–L and one repeat comprising twelve courses and twenty four wales. The wales are parallel to each other and to the longitudinal axis which extends the length of the fabric 100. The successive courses are parallel to the transverse axis which is perpendicular to the longitudinal axis and spans the fabric 100.

The fabric 100 comprise four sets of threads, the chain threads 110, the elastomeric threads 120, the front weft threads 130, and the back weft threads 140. Once the fabric 100 is released from the machine knitting elements it coalesces into a very compact configuration, because the elastomeric yarn used in each wale is under considerable tension while being knit and compacts the fabric once the tension is released.

As shown in FIG. 1, the fabric 100 is in a fully extended condition both crosswise and lengthwise. The extended view allows the complex interlacing of the four sets of threads 110, 120, 130, and 140 to be viewed.

The chain threads 110 are fed from a warp with one thread fed to each needle on which a chain is desired, to form rows of chain stitches defining the wales a–l. The chain stitch is common to all knitted elastic and forms the base structure of the fabric.

The elastomeric threads 120, which give the fabric its elastic qualities, are fed from a device common to all knit elastic machines, and provide the high tension necessary while knitting. One thread is placed in each needle wale and is sandwiched between the front weft threads 130 and the back weft threads 140. It is laid-in, and thus is never formed into stitches by the needles. The underlap of the chain stitch ties it to the fabric 100.

The front and back sets of weft threads 130 and 140 provide the widthwise integrity of the fabric 100 by tying the wales and chain stitches together. Each set of weft threads 130 and 140 is carried in a separate bar on the machine and each bar is moved to the desired position from side to side on each course by a pattern wheel. While a pattern is needed for each bar, the pattern is the same for both front and back weft bars in the fabric 100.

Beginning with course A at the bottom of FIG. 1 the pattern for each weft bar is as follows: 1, 9, 1, 10, 1, 9, 5, 13, 4, 13, 5, 13. The pattern is shown in relative position at the right of FIG. 1 as pattern repeat numbers. These numbers indicate the aisles, designated 1–12, between the chain stitch wales a–l to which the weft thread moves while the course is formed. Courses A–L are the horizontal rows of stitches.

FIG. 1 shows exactly one half of a repeat of the pattern in both the lengthwise direction and the crosswise direction. The pattern repeats each twelve courses lengthwise of the fabric 100, and also repeats each twenty-four wales in width. A weft guide is used every eight needles in both weft bars. As many width repeats are used as in needed to produce a fabric of the desired width. Length of the fabric 100 is determined by continually repeating the twelve course pattern.

This unique pattern gives the fabric 100 desired qualities for elastic web to be used for orthopedic and lumbar support belts. It provides about 18% open space in the fabric in the form of holes 210, 220, 230, 240, 310, 320, 330, 340, 350, and 360, thus enabling the fabric 100 to pass air and water vapor more readily than would solid fabric. The holes are coincidentally in a pleasing pattern, allowing the garment to look better when worn. Earlier efforts, while giving sufficient hole size, lacked sufficient widthwise stability.

An important feature of this structure is the dividing of large holes into two smaller holes, designated in FIG. 1 as 210, 220, 230, and 240. The traversing of both front and back weft yarns 130 and 140 across wales e and d and h and i divides what was one large hole in the prior art into the four small holes 210–240. The large holes tended to open up under lateral stress.

A further stabilizing factor in the resistance to lateral stress results from traversing both bars the entire width of the twelve wale repeat once every twelve courses. This is represented by the long inlays of yarns 130 and 140 from point 410 at the junction of the first wale a and the last course L to point 420 at the junction of the twelfth wale 1 and the last course L. Such long straight segments of yarn greatly reduce widthwise stretch.

In addition to the four larger holes designated in FIG. 1 as 210–240, there are the six smaller holes designated as 310–360. All together each repeat of the pattern has ten holes which gives sufficient ventilation of 12 to 25% of the surface area depending on extension.

The fabric 100 in accordance with the present invention having the described stitch structure allows other advantages in the production of vented elastic webbing. For example, because the pattern repeats in a twenty four wale width it can be readily produced in any multiple of twenty four wales. However, if four needles are removed on each side of the desired web width, a selvage will be formed. This selvage would ordinarily be four wales wide on either side but can be reduced to three wales or two wales, if desired, by conventional means as will be understood by those of ordinary skill in the art.

In other methods of producing solid elastic webs, only webs of the same width could be produced on a machine simultaneously. With the fabric in accordance with the present invention, varying widths can be produced on a machine at the same time thus allowing greater utilization of equipment and greater productivity.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

What is claimed is:

1. A method of making a breathable elastic web fabric, comprising the steps of:

(a) providing a set of chain threads, a set of elastomeric threads, a set of front weft threads, and a set of back weft threads;

(b) knitting the chain threads into rows of chain stitches to define a plurality of lengthwise wales and widthwise courses, each chain stitch having an underlap;

(c) moving the front and the back weft threads from side to side on each course in a pre-determined pattern as each course is formed to tie the wales and the chain stitches together and to provide a plurality of staggered sets of ventilation holes, each set comprising at least two holes, the holes in each set being separated by at least one locking stitch to provide the fabric with widthwise stability; and (d) laying-in one elastomeric thread in each of the wales to sandwich the elastomeric thread between the front weft threads and the back weft threads and enclose the elastomeric thread in the underlap of each chain stitch.

2. The method of claim 1, wherein the fabric has an extended surface area and wherein in said step (c), the front and back weft threads are moved to provide a plurality of ventilation holes which comprise approximately 12 per cent to approximately 25 per cent of the extended surface area of the fabric.

3. The method of claim 1, wherein in said step (c), the front and the back weft threads are moved to provide two holes in each set of ventilation holes, and one locking stitch separating the holes in each set.

4. The method of claim 1, wherein in said step (c), each set of threads is carried in a separate bar and each separate bar is moved in a pattern to a desired position from side to side on each course by a pattern wheel.

5. The method of claim 4, wherein the pattern is identical for the bar carrying the front weft thread and the bar carrying the back weft thread.

6. The method of claim 4, wherein the pattern for each weft bar is 1, 9, 1, 10, 1, 9, 5, 13, 4, 13, 5, 13.

7. The method of claim 1, wherein in said step (b), the chain threads are fed from a warp with one thread fed to each needle on which a chain is desired, to form rows of chain stitches defining the wales.

8. A breathable elastic web fabric, comprising:

a set of chain threads knit into rows of chain stitches defining a plurality of wales, each chain stitch having an underlap;

a set of front weft threads and a set of back weft threads, each of said front weft threads being associated with one of said back weft threads to form pairs of front and back weft threads, and each of said pairs of front and back weft threads traversing said rows of chain stitches in a pattern to define a plurality of staggered sets of ventilation holes, each of the sets of holes comprising at least two holes and at least one locking stitch separating said holes in each said set, said locking stitches providing said fabric with widthwise stability; and a set of elastomeric threads, one said elastomeric thread being laid-in in each said wale and sandwiched between said front weft threads and said back weft threads and enclosed in said underlap of said chain threads, said underlap of said chain stitches tying said elastomeric threads to said weft threads.

9. The fabric of claim 8, wherein the front and back threads are spaced eight needles apart in each set.

10. The elastic web fabric of claim 8, wherein the fabric has an extended surface area and wherein said ventilation holes comprise approximately 12 per cent to approximately 25 per cent of the extended surface area of said fabric.

11. The elastic web fabric of claim 8, wherein said rows of chain stitches define a plurality of widthwise courses, and wherein said fabric has a pattern which repeats each twelve courses lengthwise and each twenty four wales widthwise.

12. The elastic web fabric of claim 11, wherein an aisle is defined between adjacent wales, whereby each twenty four wales in a pattern repeat is associated with twenty five aisles, and wherein said aisles to which said weft threads move in each pattern repeat are 1, 9, 1, 10, 1, 9, 5, 13, 4, 13, 5, 13.

13. A method of making a breathable elastic web fabric, comprising the steps of:

(a) providing a set of chain threads, a set of elastomeric threads, a set of front weft threads, and a set of back weft threads;

(b) knitting the chain threads into rows of chain stitches to define a plurality of lengthwise wales and widthwise courses, each chain stitch having an underlap;

(c) moving the front and the back weft threads from side to side on each course in a pre-determined pattern as each course is formed to tie the wales and the chain stitches together and to provide a plurality of staggered ventilation holes; and (d) laying-in one elastomeric thread in each of the wales to sandwich the elastomeric thread between the front weft threads and the back weft threads and enclose the elastomeric thread in the underlap of each chain stitch.

14. The method of claim 13, wherein in said step (c), each weft thread is carried in a separate bar and each separate bar is moved in a pattern to a desired position from side to side on each course by a pattern wheel.

15. The method of claim 14, wherein the pattern for each weft bar is 1, 9, 1, 10, 1, 9, 5, 13, 4, 13, 5, 13.

16. The method of claim 14, wherein the pattern is identical for the bar carrying the front weft thread and the bar carrying the back weft thread.

17. The method of claim 13, wherein in said step (b), the chain threads are fed from a warp with one thread fed to each needle on which a chain is desired.

18. A breathable elastic web fabric, comprising:

a set of chain threads knit into rows of chain stitches defining a plurality of wales, each chain stitch having an underlap;

a set of front weft threads and a set of back weft threads, each of said front weft threads being associated with one of said back weft threads to form a pair of front and back weft threads, and each pair of front and back weft threads traversing said rows of chain stitches in a pattern to define a plurality of staggered ventilation holes; and a set of elastomeric threads, one said elastomeric thread being laid-in in each said wale and sandwiched between said front weft threads and said back weft threads and enclosed in said underlap of said chain threads, said underlap of said chain stitches tying said elastomeric threads to said weft threads.

19. The elastic web fabric of claim 18, wherein the fabric has an extended surface area and wherein the ventilation holes comprise approximately 12 per cent to approximately 25 per cent of the extended surface area of the fabric.

20. The fabric of claim 18, wherein said front and back threads are spaced eight needles apart in each said set.

21. The elastic web fabric of claim 18, wherein said rows of chain stitches define a plurality of widthwise courses, and wherein said fabric has a pattern which repeats each twelve courses lengthwise and each twenty four wales widthwise.

22. The elastic web fabric of claim 21, wherein an aisle is defined between adjacent wales, whereby each twenty four wales in a pattern repeat is associated with twenty five aisles, and wherein said aisles to which said weft threads move in each pattern repeat are 1, 9, 1, 10, 1, 9, 5, 13, 4, 13, 5, 13.

* * * * *